US007458541B1

(12) United States Patent
Chang

(10) Patent No.: US 7,458,541 B1
(45) Date of Patent: Dec. 2, 2008

(54) TISSUE ROLL HOLDER

(76) Inventor: Tai-In Chang, 2F, No. 63, Sec. 4, Hsin-I Rd., Taipei (TW)

( * ) Notice: Subject to any disclaimer, the term of this patent is extended or adjusted under 35 U.S.C. 154(b) by 0 days.

(21) Appl. No.: 11/820,191

(22) Filed: Jun. 18, 2007

(51) Int. Cl.
*B65H 75/18* (2006.01)

(52) U.S. Cl. ..... 242/597.7; 242/591; 248/205.8; 248/206.2

(58) Field of Classification Search ..... 242/597.7, 242/597.4, 596.8, 597.5, 597.6, 597.8, 599.4, 242/599.3; 248/205.8, 205.9, 205.5
See application file for complete search history.

(56) References Cited

U.S. PATENT DOCUMENTS

| | | | | | |
|---|---|---|---|---|---|
| 952,495 | A * | 3/1910 | Austin | 248/205.8 |
| 2,047,658 | A * | 7/1936 | Zaiger | 248/205.8 |
| 2,657,893 | A * | 11/1953 | Puckert | 248/205.8 |
| 3,240,461 | A * | 3/1966 | Singleton | 248/205.8 |
| 4,012,007 | A * | 3/1977 | Cunningham | 242/597.7 |
| 4,133,575 | A * | 1/1979 | Mader | 248/205.8 |
| 6,405,973 | B1 * | 6/2002 | Hollinger | 242/597.7 |
| 6,478,271 | B1 * | 11/2002 | Mulholland | 248/205.8 |
| 6,932,306 | B2 * | 8/2005 | Zou et al. | 248/205.5 |
| 7,264,197 | B2 * | 9/2007 | Yu | 242/597.7 |

* cited by examiner

*Primary Examiner*—William A Rivera
(74) *Attorney, Agent, or Firm*—Ladas & Parry, LLP

(57) ABSTRACT

A tissue roll holder includes a sucking member having a threaded rod connected to and extending upwardly from a central portion of a flexible disc body, an abutting plate disposed above the disc body and permitting extension of the threaded rod therethrough, and a mounting seat disposed on the abutting plate for mounting a tissue roll and having a threaded hole that engages the threaded rod. When a peripheral portion of the disc body is pressed by a peripheral abutting portion of the abutting plate and is attached sealingly to a supporting surface, the mounting seat is rotatable about the threaded rod relative to the abutting plate so as to move the threaded rod and the central portion of the disc body upwardly away from the supporting surface, thereby forming a vacant space between the central portion of the disc body and the supporting surface.

3 Claims, 9 Drawing Sheets

TISSUE ROLL HOLDER

BACKGROUND OF THE INVENTION

1. Field of the Invention

The invention relates to a tissue holder, more particularly to a tissue roll holder.

2. Description of the Related Art

FIGS. 1 and 2 illustrate a conventional tissue roll holder 1 that includes a disc-shaped base 11, a mounting rod 12 extending upwardly from a top surface of the base 11, a resilient curved abutting plate 15 that extends from a periphery of the base 11 toward a top end of the mounting rod 12, and a curved handgrip 14 that extends upwardly from the periphery of the base 11 and that is disposed between the abutting plate 15 and the mounting rod 12. The abutting plate 15 has an abutting end 151 that abuts against an annular outer surface of a tissue roll 2 to be sleeved on the mounting rod 12, as shown in FIG. 2.

In such a configuration, although the conventional tissue roll holder 1 can be placed on a supporting surface, such as a table surface, the conventional tissue roll holder 1 is not positioned. As such, the handgrip 14 must be held by one hand of a user for positioning the conventional tissue roll holder 1 so as to allow tissues 22 to be torn from the tissue roll 2 by the other hand of the user, thereby resulting in inconvenience during use.

SUMMARY OF THE INVENTION

Therefore, the object of the present invention is to provide a repositionable tissue roll holder.

According to the present invention, a tissue roll holder comprises:

a sucking member having a flexible disc body that has a peripheral portion adapted to be attached sealingly to a supporting surface, and a central portion connected integrally to the peripheral portion and adapted to be spaced apart from the supporting surface, and a threaded rod connected to and extending upwardly from the central portion of the disc body;

an abutting plate having an upwardly protruding convex central portion disposed above and spaced apart from the central portion of the disc body of the sucking member, and permitting extension of the threaded rod of the sucking member therethrough, and a peripheral abutting portion extending horizontally, radially and outwardly from a periphery of the central portion of the abutting plate and abutting against the peripheral portion of the disc body of the sucking member; and a mounting seat disposed on the abutting plate and having a generally horizontal loading plate that is formed with a threaded hole for engaging the threaded rod of the sucking member, that is rotatable about the threaded rod of the sucking member relative to the abutting plate, and that is adapted for loading a tissue roll thereon, and a mounting rod connected to and extending upwardly from the loading plate and adapted for permitting the tissue roll to be sleeved thereon.

The mounting seat is rotatable relative to the abutting plate about the threaded rod so as to move the threaded rod of the sucking member and the central portion of the disc body of the sucking member upwardly away from the supporting surface, thereby forming a vacant space between the central portion of the disc body of the sucking member and the supporting surface.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
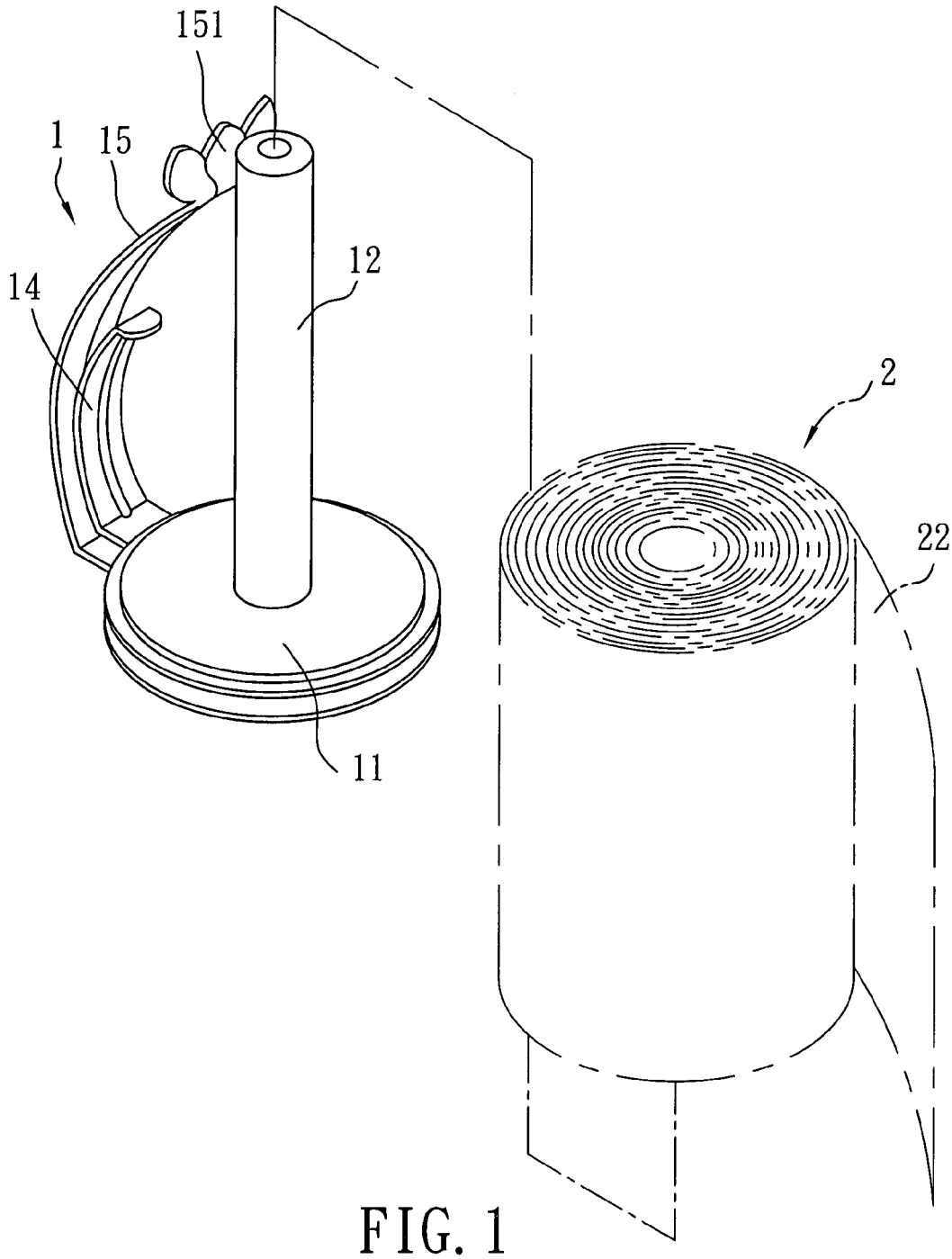
FIG. 1 PRIOR ART
FIG. 1 is a perspective view of a conventional tissue roll holder.
Figure 2:
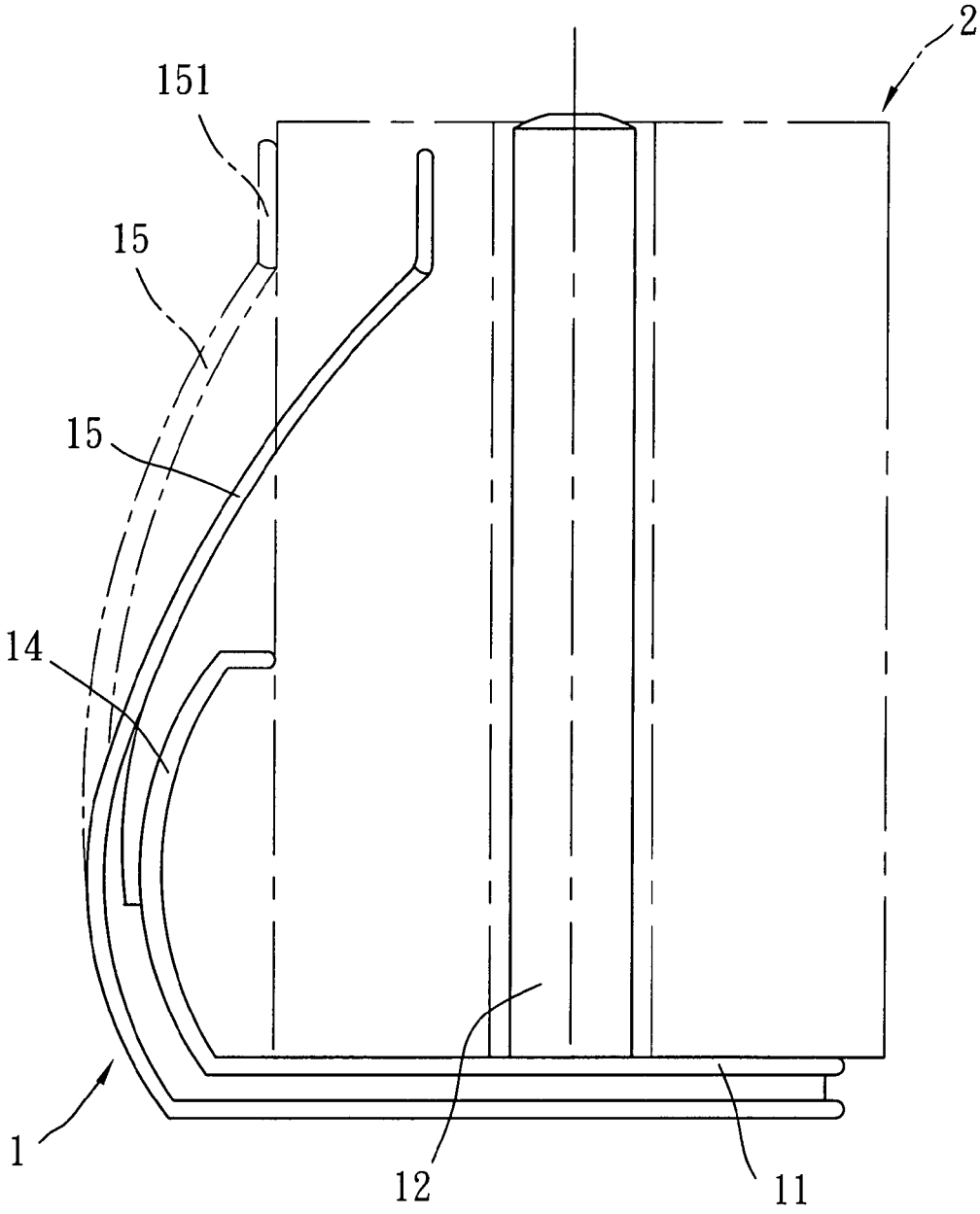
FIG. 2 PRIOR ART
FIG. 2 is a schematic side view of the conventional tissue roll holder.

Before the present invention is described in greater detail, it should be noted that like elements are denoted by the same reference numerals throughout the disclosure.

Figure 3:
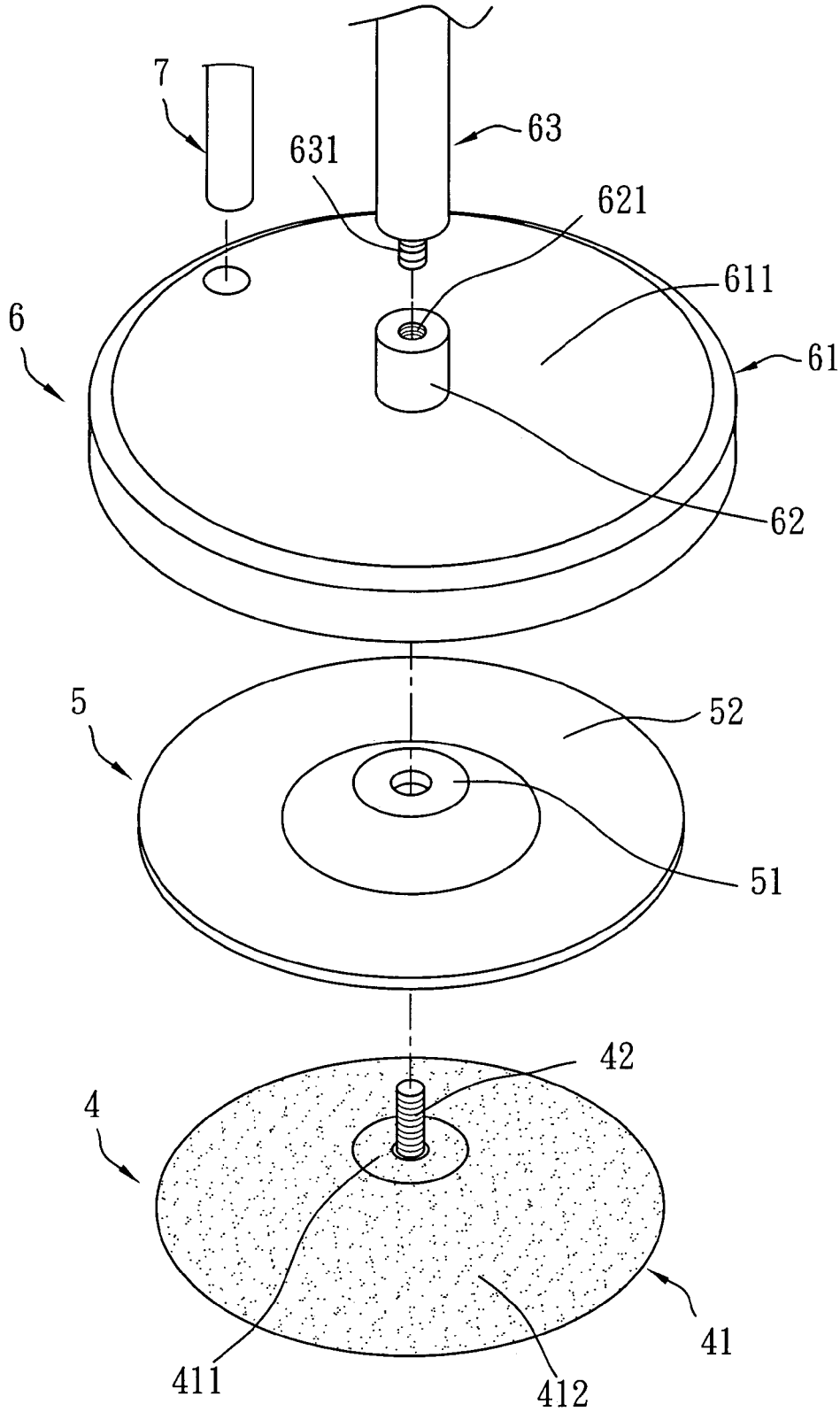
FIG. 3 is an exploded fragmentary perspective view showing the first preferred embodiment of a tissue roll holder according to the present invention.
Figure 4:
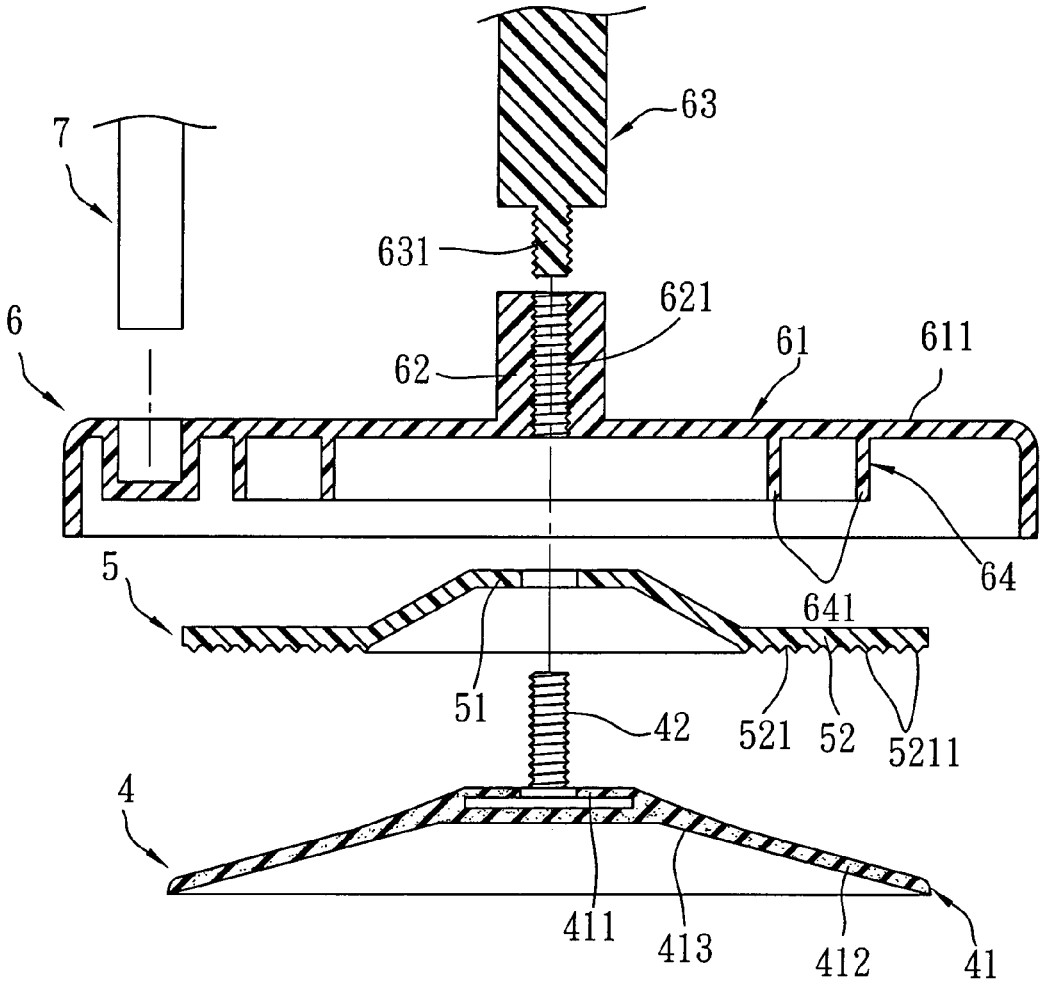
FIG. 4 is an exploded fragmentary, schematic sectional view showing the first preferred embodiment.
Figure 7:
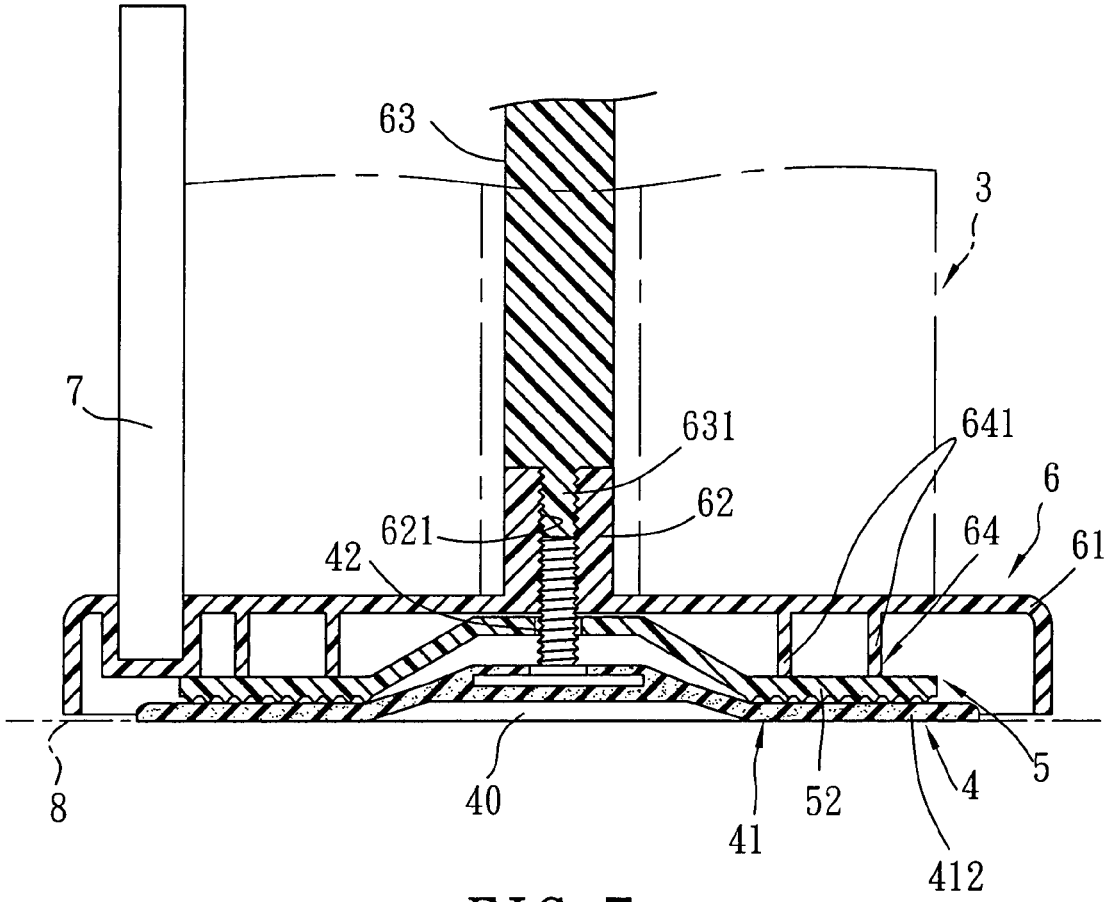
FIG. 7 is a fragmentary schematic sectional view showing the first preferred embodiment when in a positioned state.

Referring to FIGS. 3, 4 and 7, the first preferred embodiment of a tissue roll holder according to the present invention is shown to include a sucking member 4, an abutting plate 5, a mounting seat 6, and a positioning unit.

The sucking member 4 has a flexible disc body 41 and a threaded rod 42. The disc body 41 is made of rubber, and has a peripheral portion 412 adapted to be attached sealingly to a supporting surface 8, and a central portion 411 connected integrally to the peripheral portion 412 and adapted to be spaced apart from the supporting surface 8. The threaded rod 42, such as a metal screw, is connected fixedly to and extends upwardly from the central portion 411 of the disc body 41.

The abutting plate 5 is made of hard plastic, and has an upwardly protruding convex central portion 51, and a peripheral abutting portion 52. The central portion 51 of the abutting plate 5 is disposed above and is spaced apart from the central portion 411 of the disc body 41 of the sucking member 4, and permits extension of the threaded rod 42 of the sucking member 4 therethrough. The peripheral abutting portion 52 of the abutting plate 5 extends horizontally, radially and outwardly from a periphery of the central portion 51 of the abutting plate 5, and abuts against the peripheral portion 412 of the disc body 41 of the sucking member 4. The peripheral abutting portion 52 of the abutting plate 5 has a toothed bottom surface 521 that is in frictional contact with the peripheral portion 412 of the disc body 41 of the sucking member 4, as shown in FIG. 7. In this embodiment, the toothed bottom surface 521 of the peripheral abutting portion 52 is formed with a plurality of concentric annular protrusions 5211, as shown in FIG. 4.

The mounting seat 6 is disposed on the abutting plate 5, and has a generally horizontal circular loading plate 61 and amounting rod 62. In this embodiment, the loading plate 61 is made of hard plastic, and has an area larger than that of a tissue roll 3 to be loaded thereon (see FIG. 7). The loading plate 61 has an upwardly extending central connecting portion 62 formed with a threaded hole 621 for engaging the threaded rod 42 of the sucking member 4, is rotatable about the threaded rod 42 of the sucking member 4 relative to the abutting plate 5, and is adapted for loading the tissue roll 3 thereon. The mounting rod 63 is connected to and extends upwardly from the loading plate 61, and is adapted for permitting the tissue roll 3 to be sleeved thereon. In this embodiment, the mounting rod 63 has a threaded end portion 631 engaging the threaded hole 621 in the central connecting portion 62 of the loading plate 61 of the mounting seat 6. The mounting seat 6 further has an abutting member 64 consisting of two concentric annular ribs 641 that extend integrally and downwardly from a bottom side of the loading plate 61 and that is in slidable contact with the peripheral abutting portion 52 of the abutting plate 5.

The positioning unit is mounted on the mounting seat 6 for positioning the tissue roll 3 on the mounting seat 6. In this embodiment, the positioning unit includes an upright positioning rod 7 mounted fixedly on a top surface 611 of the loading plate 61 of the mounting seat 6 so that the tissue roll 3 is positioned between and is in contact with the positioning rod 7 and the mounting rod 63.

Figure 5:
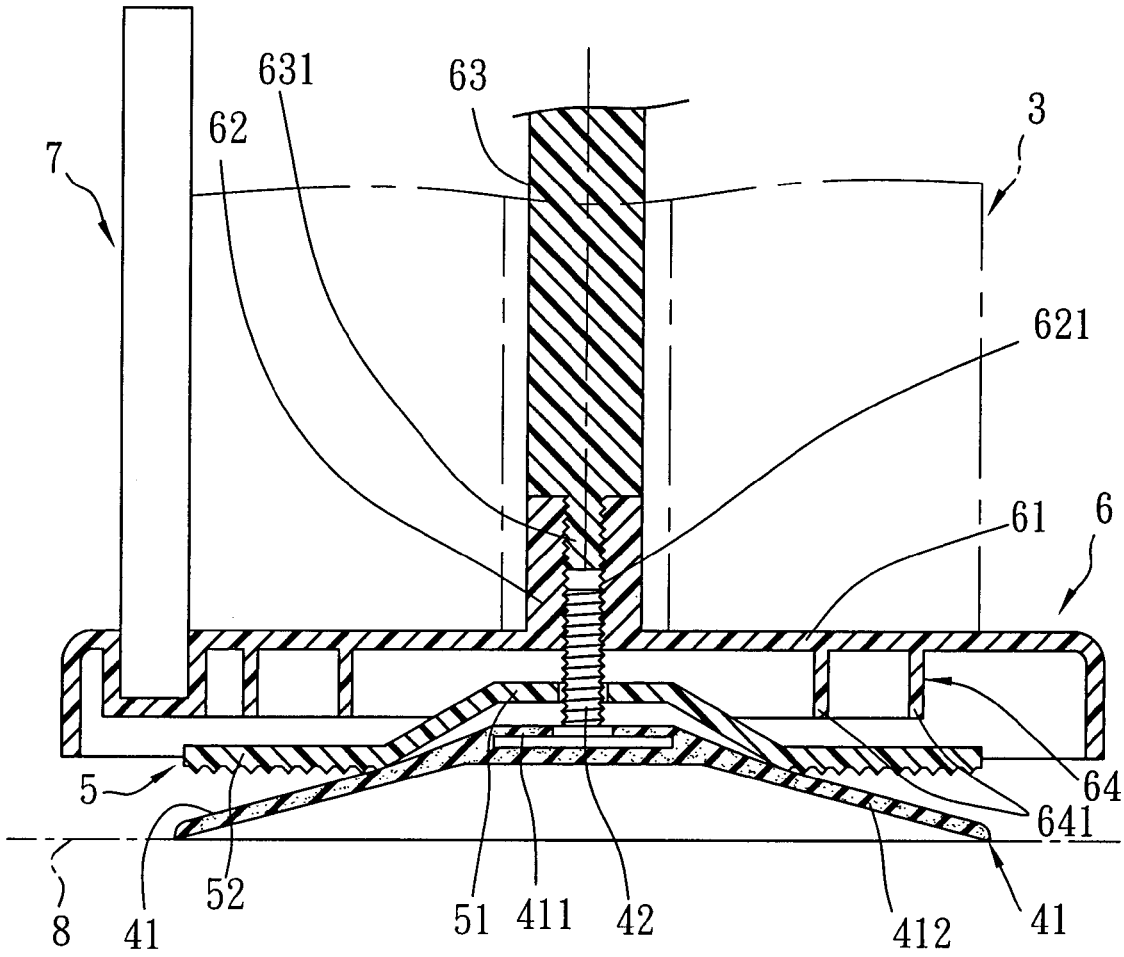
FIG. 5 is a fragmentary schematic sectional view showing the first preferred embodiment when in a non-positioned state.
Figure 6:
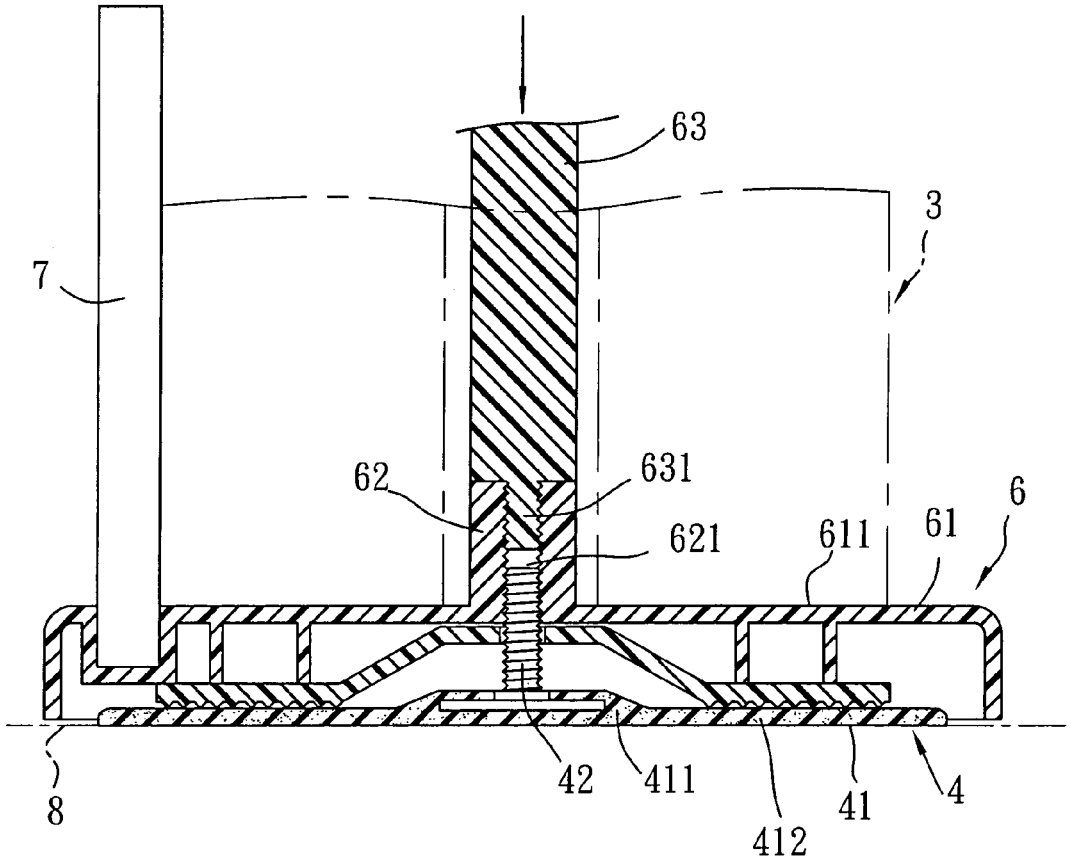
FIG. 6 is a fragmentary schematic sectional view showing the first preferred embodiment when a disc body of the first preferred embodiment is attached to a supporting surface.

In actual operation, the tissue roll holder is operable so as to switch between a non-positioned state (see FIG. 5) and a positioned state (see FIG. 7). During transition of the tissue roll holder from the non-positioned state to the positioned state, the disc body 41 of the sucking member 4 is pressed downwardly to be attached to the supporting surface 8, as shown in FIG. 6, and then, the mounting seat 6 is rotated relative to the abutting plate 5 about the threaded rod 42 so as to move the threaded rod 42 and the central portion 411 of the disc body 41 upwardly away from the supporting surface 8, thereby forming a vacant space 40 between the central portion 411 of the disc body 41 and the supporting surface 8. As such, the tissue roll holder can be stably positioned on the supporting surface 8, thereby facilitating tearing of tissues from the tissue roll 3 during use.

Figure 8:
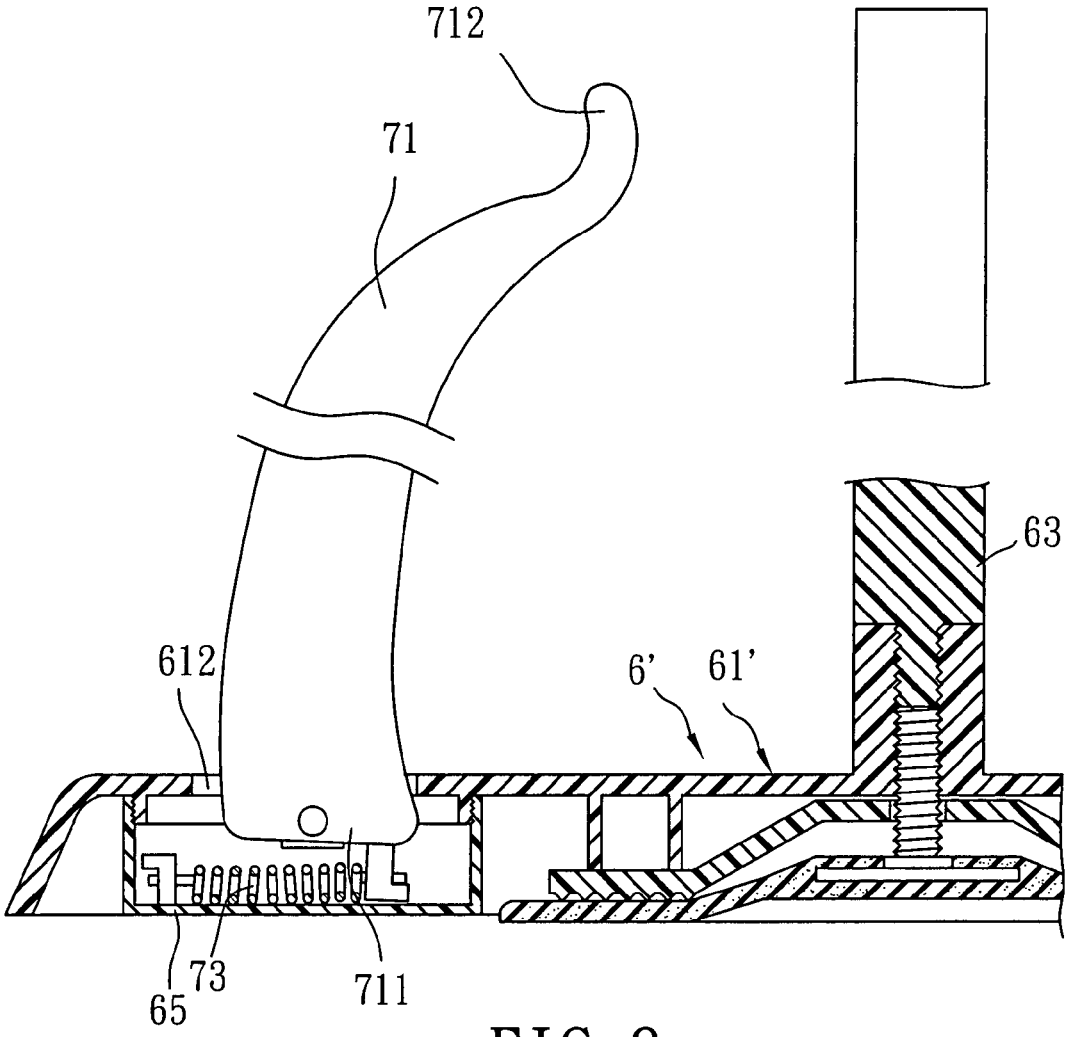
FIG. 8 is a fragmentary schematic sectional view showing the second preferred embodiment of a tissue roll holder according to the present invention.
Figure 9:
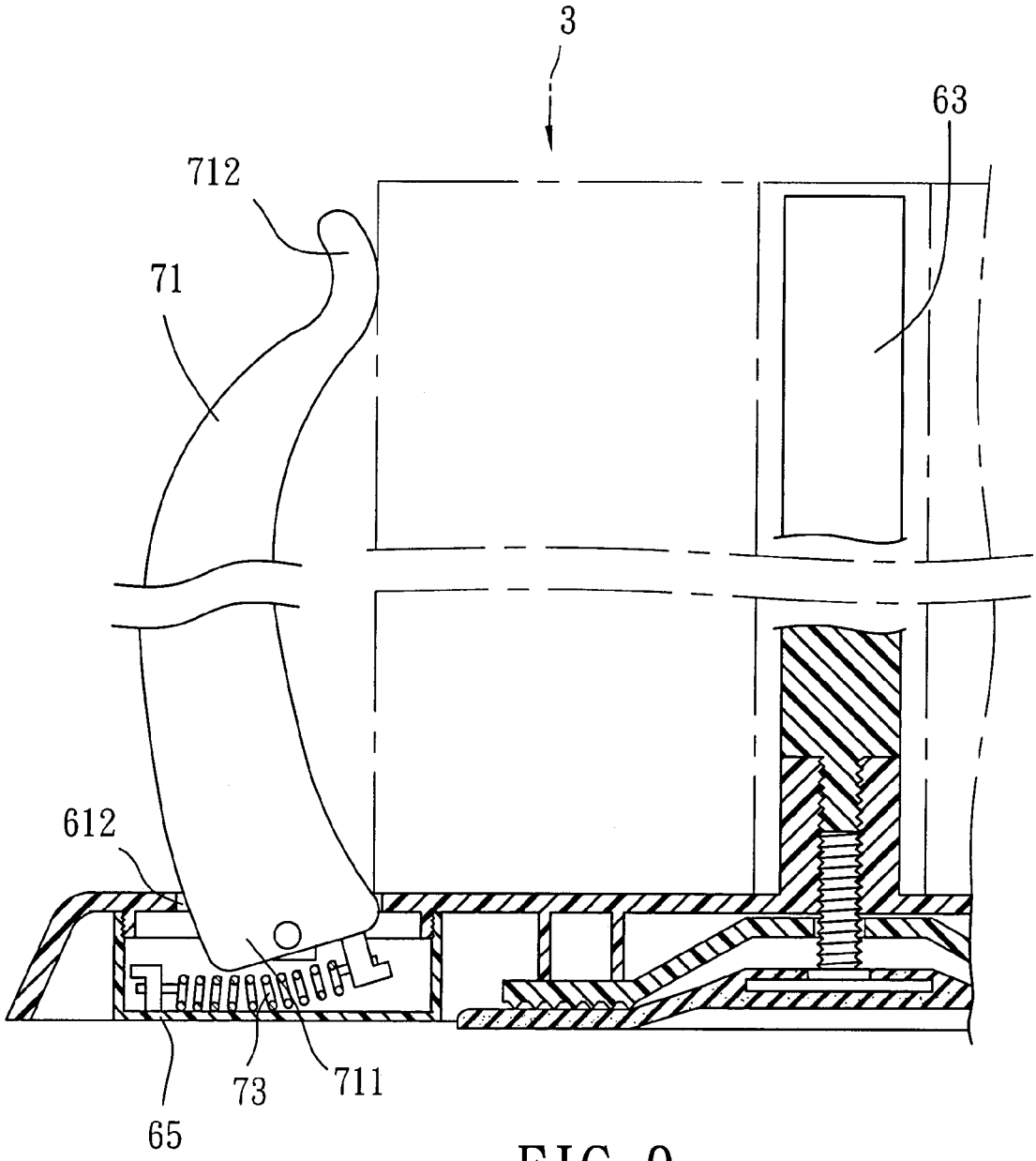
FIG. 9 is a fragmentary schematic sectional view showing the second preferred embodiment when in a state of use.

FIGS. 8 and 9 illustrate the second preferred embodiment of a tissue roll holder according to this invention, which is a modification of the first preferred embodiment. In this embodiment, the loading plate 61' of the mounting seat 6' is formed with a through hole 612 disposed adjacent to a periphery of the loading plate 61', and has a spring-receiving seat 65 mounted on the bottom side of the loading plate 61' and disposed adjacent to the through hole 612.

The positioning unit includes a positioning rod 71 and a coil spring 73. The positioning rod 71 has a lower pivot end 711 that extends into the spring-receiving seat 65 through the through hole 612 in the loading plate 61' of the mounting seat 6' and that is connected pivotally to the spring-receiving seat 65, and an upper abutting end 712 adapted to abut against an annular outer surface of the tissue roll 3, as shown in FIG. 9. The coil spring 73 is disposed in the spring-receiving seat 65, and interconnects the spring-receiving seat 65 and the lower pivot end 711 of the positioning rod 71 for biasing the upper abutting end 712 of the positioning rod 71 to press against the annular outer surface of the tissue roll 3, thereby positioning the tissue roll 3 between the positioning rod 71 and the mounting rod 63.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A tissue roll holder comprising:

a sucking member having a flexible disc body that has a peripheral portion adapted to be attached sealingly to a supporting surface, and a central portion connected integrally to said peripheral portion and adapted to be spaced apart from the supporting surface, and a threaded rod connected to and extending upwardly from said central portion of said disc body;

an abutting plate having an upwardly protruding convex central portion disposed above and spaced apart from said central portion of said disc body of said sucking member, and permitting extension of said threaded rod of said sucking member therethrough, and a peripheral abutting portion extending horizontally, radially and outwardly from a periphery of said central portion of said abutting plate and abutting against said peripheral portion of said disc body of said sucking member;

a mounting seat disposed on said abutting plate and having a generally horizontal loading plate that is formed with a threaded hole for engaging said threaded rod of said sucking member, that is rotatable about said threaded rod of said sucking member relative to said abutting plate, and that is adapted for loading a tissue roll thereon, and a mounting rod connected to and extending upwardly from said loading plate and adapted for permitting the tissue roll to be sleeved thereon, said loading plate being formed with a through hole disposed adjacent to a periphery of said loading plate, and having a spring-receiving seat mounted on a bottom side of said loading plate and disposed adjacent to said through hole; and a positioning unit mounted on said mounting seat and adapted for positioning the tissue roll on said mounting seat, said positioning unit including a positioning rod having a lower pivot end that extends into said spring-receiving seat through said through hole in said loading plate of said mounting seat and that is connected pivotally to said spring-receiving seat, and an upper abutting end adapted to abut against an annular outer surface of the tissue roll, and a coil spring disposed in said spring-receiving seat and interconnecting said spring-receiving seat and said lower pivot end of said positioning rod for biasing said upper abutting end of said positioning rod to press against the annular outer surface of the tissue roll, thereby positioning the tissue roll between said positioning rod and said mounting rod;

wherein said mounting seat is rotatable relative to said abutting plate about said threaded rod so as to move said threaded rod of said sucking member and said central portion of said disc body of said sucking member upwardly away from the supporting surface, thereby forming a vacant space between said central portion of said disc body of said sucking member and the supporting surface.

2. The tissue roll holder as claimed in claim 1, wherein said mounting seat further has an abutting member that extends integrally and downwardly from a bottom side of said loading plate and that is in slidable contact with said peripheral abutting portion of said abutting plate.

3. The tissue roll holder as claimed in claim 1, wherein said peripheral abutting portion of said abutting plate has a toothed bottom surface that is in frictional contact with said peripheral portion of said disc body of said sucking member.

* * * * *